US005843494A

United States Patent [19]

Richardson

[11] Patent Number: 5,843,494

[45] Date of Patent: Dec. 1, 1998

[54] POSITIONING DEVICE FOR SLIDABLE CORE

[75] Inventor: Fraser Richardson, Oakville, Canada

[73] Assignee: Amcan Castings Limited, Hamilton, Canada

[21] Appl. No.: 50,994

[22] Filed: Mar. 31, 1998

[51] Int. Cl.[6] ..... B29C 33/00

[52] U.S. Cl. ..... 425/468; 164/340; 249/63

[58] Field of Search ..... 164/340; 249/63, 249/64; 425/468

[56] References Cited

U.S. PATENT DOCUMENTS

| | | | |
|---|---|---|---|
| 617,396 | 1/1899 | Hay | 249/64 |
| 3,124,842 | 3/1964 | Moormann | 425/468 |
| 3,433,292 | 3/1969 | McDonald | 249/64 |
| 3,849,053 | 11/1974 | Bruce et al. | 425/468 |
| 4,919,189 | 4/1990 | Sato et al. | 164/340 |

FOREIGN PATENT DOCUMENTS

| | | | |
|---|---|---|---|
| 1023517 | 1/1978 | Canada | 425/468 |
| 58-192652 | 11/1983 | Japan | 164/340 |
| 61-29509 | 2/1986 | Japan | 425/468 |

*Primary Examiner*—Robert Davis
*Attorney, Agent, or Firm*—Rogers & Milne

[57] ABSTRACT

A positioning device for positioning a slidable core in a movable insert of a die casting mold. The positioning device utilizes a rotary actuator coupled to a piston in a hydraulic cylinder to rotate the piston and in turn a cylinder rod. The cylinder rod is provided with a coupling member at an end distal the hydraulic cylinder for releasable coupling with the slidable core for axial movement of the slidable core. An adaptor block mounts the rotary actuator to the hydraulic cylinder. The adaptor block includes a stop for limiting rotation of the rotatable components of the positioning device.

1 Claim, 5 Drawing Sheets

POSITIONING DEVICE FOR SLIDABLE CORE

FIELD OF THE INVENTION

This invention relates to movable inserts for a die casting mold, and more particularly to a positioning device for positioning a slidable core in such a movable insert.

BACKGROUND OF THE INVENTION

U.S. patent application Ser. No. 08/728,913, filed on Oct. 11, 1996, describes a device for positioning a slidable core within a movable insert in a die casting mold. FIG. 1 attached hereto is perspective view illustrating the prior art device which is generally indicated by reference 10. The device 10 includes a hydraulic cylinder 12 having an axially extending rod 14 which terminates in a key 16. The key 16 is axially movable along a key axis 18 by the hydraulic cylinder 12. The key is rotatable about the key axis 18 by a rotator 20 comprising a transverse rack 22, a pinion 24 coaxial with the key axis 18 and rod 14 and further hydraulic cylinders 26 at each end of the rack 22. In use, the key 16 is rotated to line up with a keyhole 28 in a core 30, moved axially through the keyhole 28 and further rotated to misalign the key 16 with the keyhole 28 thereby locking the rod 14 and the core 30 together to constrain them to move together axially.

In use, the above rotator design has proven problematic. It is not space efficient, does not stand up well to the high temperature environment in which it is used and the degree of rotation is difficult to control accurately. Accordingly, it is an object of the present invention to provide an improved positioning device for a slidable core which is robust, space efficient and which stops in a simple and precise manner for accurate alignment between cooperating coupling members on the slidable core and on the positioning device.

SUMMARY OF THE INVENTION

A positioning device for positioning a slidable core in a movable insert for a die casting mold, said positioning device comprising:

a hydraulic cylinder having a piston and a cylinder rod rigidly secured to said piston, said piston moving said cylinder rod along a rod axis in response to fluid pressure in said hydraulic cylinder;

a rotary actuator secured to said hydraulic cylinder by an adaptor block, said rotary actuator being rotationally coupled to said piston in said cylinder by a shaft extending between said rotary actuator and said piston, said shaft having a splined portion slidably received by said rotary actuator to enable said piston and said shaft to move along said rod axis, said rotary actuator rotating said shaft and in turn said piston and said cylinder rod in response to fluid pressure in said rotary actuator;

said shaft and said adaptor block having cooperating stop means for limiting rotation of said shaft;

said cylinder rod having a coupling member at an end distal said hydraulic cylinder for releasable coupling for axial movement of said cylinder rod to said slidable core in response to rotation of said cylinder rod.

DESCRIPTION OF DRAWINGS

A preferred embodiment of the invention is described below with reference to the accompanying drawings in which.

DESCRIPTION OF PREFERRED EMBODIMENTS

Figure 1:
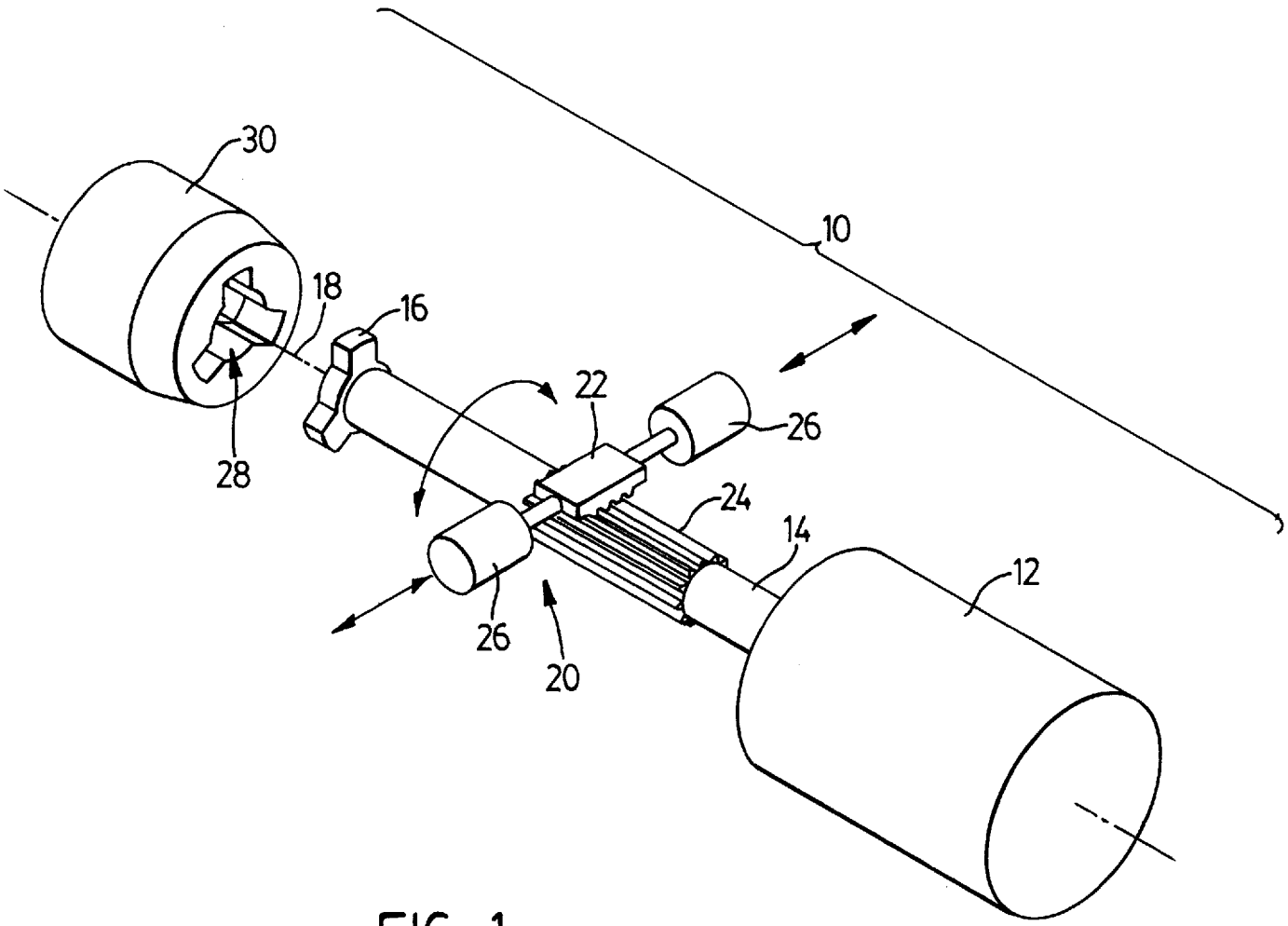
FIG. 1 (PRIOR ART)
FIG. 1 is a perspective view of a prior art device described above.
Figure 2:
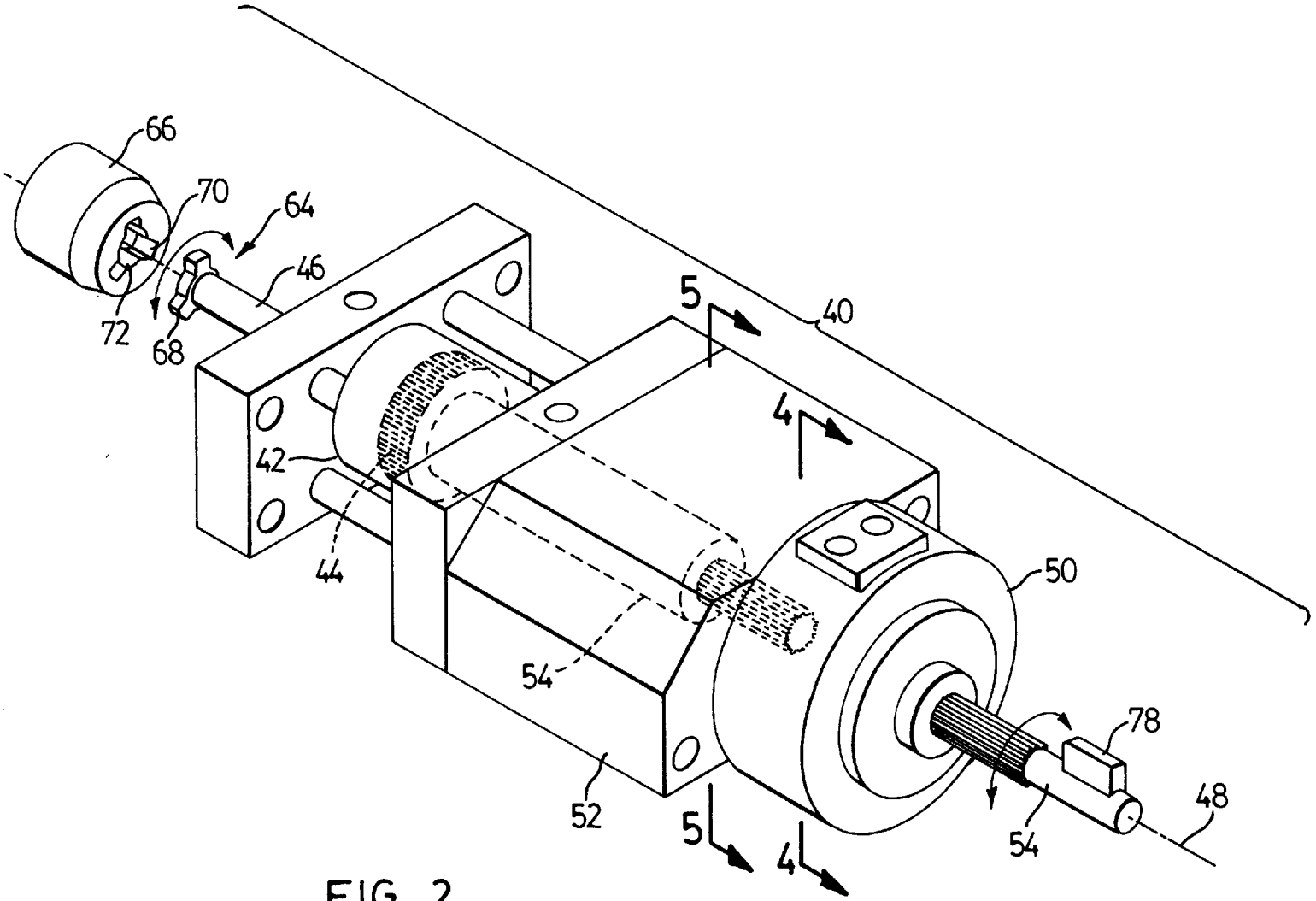
FIG. 2 is a perspective view of a positioning device according to the present invention.

A positioning device according to the present invention is generally indicated by reference 40 in FIG. 2. The positioning device 40 has a hydraulic cylinder 42 which includes a piston 44 rigidly secured to a cylinder rod 46. As typical, the piston 44 moves the cylinder rod 46 along a rod axis 48 in response to fluid pressure within the hydraulic cylinder 42.

A rotary actuator 50 is secured to the hydraulic cylinder 42 by an adaptor block 52. The rotary actuator 50 is better illustrated in FIG. 3 and is a commercially available unit, a typical unit being manufactured by Micro-Precision Operations Inc., subsidiary of Textron Inc., under model designation HS 1.5. Similar units may be available from other manufacturers and units of different capacity may be substituted depending on the requirements of a particular application. The rotary actuator 50 is rotationally coupled to the piston 44 by a shaft 54 to enable the rotary actuator 54 to rotate the piston 44 as described in more detail below.

The rotary actuator 50 has a vane 56 within a generally cylindrical chamber 58. Pressurized fluid (hydraulic fluid) can be introduced into the chamber 58 from either side of the vane 56 through ports 60. The action of the pressurized fluid on the vane 56 causes the vane 56 to rotate in the chamber 58, about the rod axis 48 in either direction, depending on which of the ports 60 acts as an inlet port for the pressurized fluid.

Figure 3:
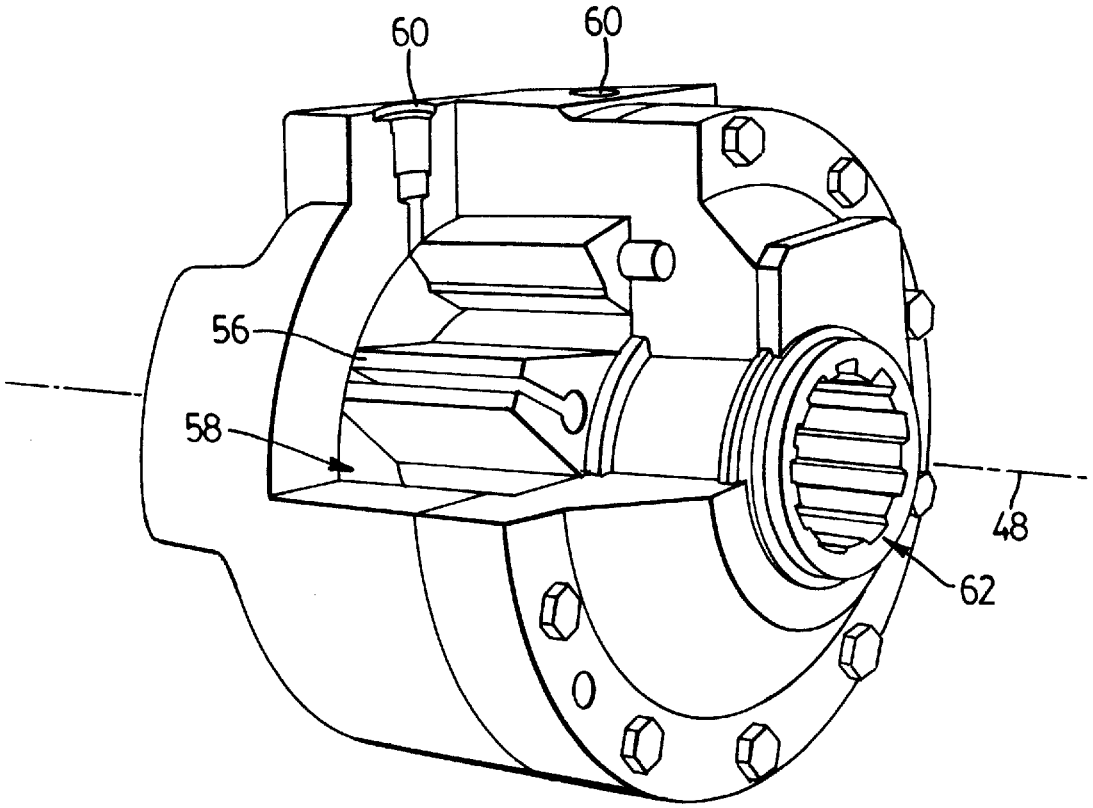
FIG. 3 is a partially cut-away view of a rotary actuator used in the present invention.
Figure 4:
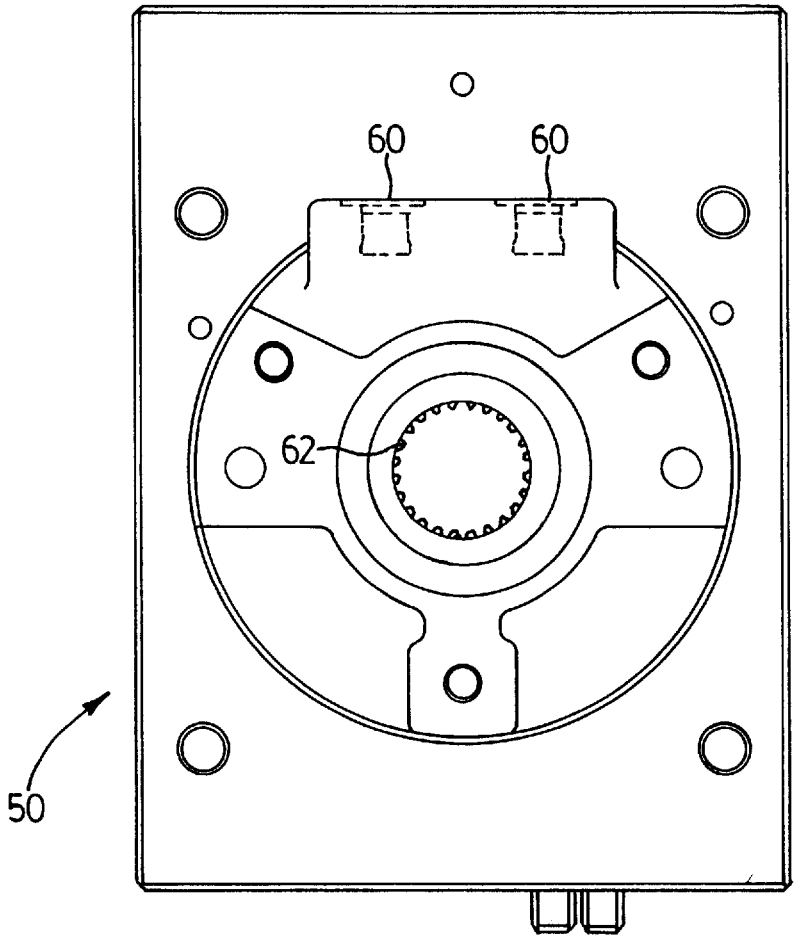
FIG. 4 is a section on line 4—4 of FIG. 1.

The shaft 54 is preferably rotationally coupled to the rotary actuator 60 by interengaging splines indicated at reference 62 in FIGS. 3 and 4 to cause the shaft 54 to be rotated by the rotary actuator 50 while allowing axial movement of the shaft 54 relative to the rotary actuator 50 in response to movement of the piston 44.

As in the prior art device 10 described above, the cylinder rod 46 has a coupling member 64 at an end distal the hydraulic cylinder 42 for releasable coupling to a slidable core 66 for axial movement of the slidable core 66. To effect the axial movement, the coupling member 64 is first rotated by activation of the rotary actuator 50 to align projections 68 on the coupling member with recesses or slots 70 in the slidable core 66. The hydraulic cylinder 42 is then actuated to axially move the coupling member 64 into the slidable core 66 at which point the coupling member 64 is rotated to align the projections 68 with lands 72 between the slots 70. This causes the coupling member 64 to couple with the slidable core 66 so that further axial movement of the cylinder rod 46 will cause corresponding axial movement of the slidable core 66. Once the slidable core 66 has been positioned, the cylinder rod 46 is rotated by actuation of the rotary actuator 50 to once again align the slots 70 with the projections 68 enabling the coupling member 64 to be uncoupled from the slidable core 66 and withdrawn along with the cylinder rod 46.

Figure 5:
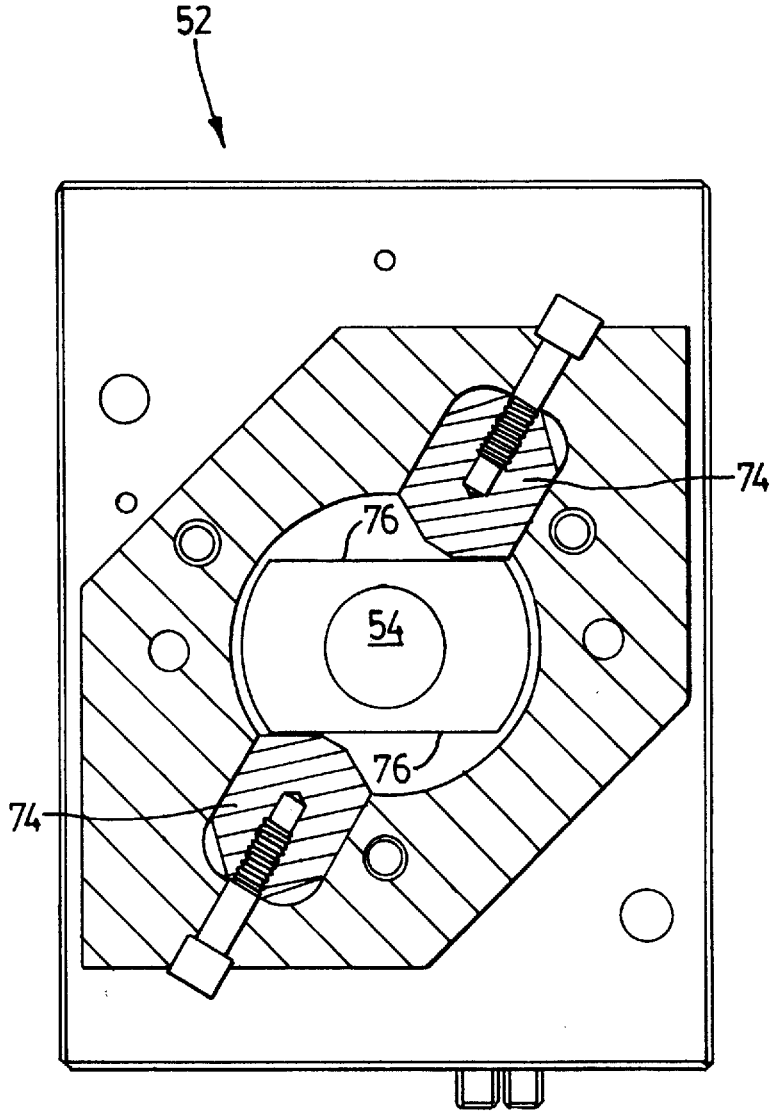
FIG. 5 is a section on line 5—5 of FIG. 1.

In order to accurately control rotation of the coupling member 64, the adaptor block 52 and shaft 54 are provided with cooperating stop means which are illustrated in the sectional view of FIG. 5. The cooperating stop means comprises opposed blocks 74 rigidly secured to the adaptor block 52 which abut against flats 76 provided on the shaft 54 or on a member rigidly secured to the shaft 54 to limit rotation of the shaft 54 in either direction without hampering axial movement of the shaft 54.

A sensor actuator 78 may be secured to the shaft 54 to provide input means to a sensor or other device responding to rotation of the shaft 54.

The above description is intended in an illustrative rather than a restrictive sense. Variations to the exact description above may be apparent to persons skilled in such devices and it is intended that any variations which do not depart from the spirit and scope of the claims set out below be deemed as falling within the scope of this patent.

I claim:

1. A positioning device for positioning a slidable core in a movable insert for a die casting mold, said positioning device comprising:

a hydraulic cylinder having a piston and a cylinder rod rigidly secured to said piston, said piston moving said cylinder rod along a rod axis in response to fluid pressure in said hydraulic cylinder;

a rotary actuator secured to said hydraulic cylinder by an adaptor block, said rotary actuator being rotationally coupled to said piston in said cylinder by a shaft extending between said rotary actuator and said piston, said shaft having a splined portion slidably received by said rotary actuator to enable said piston and said shaft to move along said rod axis, said rotary actuator rotating said shaft and in turn said piston and said cylinder rod in response to fluid pressure in said rotary actuator;

said shaft and said adaptor block having cooperating stop means for limiting rotation of said shaft;

said cylinder rod having a coupling member at an end distal said hydraulic cylinder for releasable coupling for axial movement of said cylinder rod to said slidable core in response to rotation of said cylinder rod.

* * * * *